US009061776B2

(12) United States Patent
Kurose et al.

(10) Patent No.: US 9,061,776 B2
(45) Date of Patent: Jun. 23, 2015

(54) MEDICINE PACKAGING BAG AND SHEET FOR THE SAME

(75) Inventors: Takafumi Kurose, Toyonaka (JP); Eiji Sadamori, Toyonaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 292 days.

(21) Appl. No.: 13/497,776

(22) PCT Filed: Sep. 9, 2010

(86) PCT No.: PCT/JP2010/065511

§ 371 (c)(1),
(2), (4) Date: Mar. 22, 2012

(87) PCT Pub. No.: WO2011/037021

PCT Pub. Date: Mar. 31, 2011

(65) Prior Publication Data

US 2012/0217180 A1 Aug. 30, 2012

(30) Foreign Application Priority Data

Sep. 24, 2009 (JP) ..... 2009-218889

(51) Int. Cl.
*B65D 83/04* (2006.01)
*B65D 85/42* (2006.01)
(Continued)

(52) U.S. Cl.
CPC ..... *B65B 9/073* (2013.01); *B65B 51/28* (2013.01); *B65B 61/02* (2013.01); *B65D 75/20* (2013.01); *B65D 75/42* (2013.01); *B65D 75/527* (2013.01); *B65D 75/58* (2013.01); *B65D 2575/58* (2013.01)

(58) Field of Classification Search
USPC ..... 206/540, 532, 534.2, 529, 528, 530, 206/539; 383/220–229, 200
See application file for complete search history.

(56) References Cited

U.S. PATENT DOCUMENTS 3,809,220 A * 5/1974 Arcudi ..... 383/200
4,543,279 A 9/1985 Kai
(Continued)

FOREIGN PATENT DOCUMENTS

CN 2159944 3/1994
CN 2242858 12/1996
(Continued)

OTHER PUBLICATIONS

European Search Report for EP 10818696.6 dated Jun. 11, 2014.
(Continued)

*Primary Examiner* — Mickey Yu
*Assistant Examiner* — Chun Cheung
(74) *Attorney, Agent, or Firm* — Jones Day

(57) ABSTRACT

An elongated sheet for a medicine packaging bag is provided. The sheet can be folded centrally in a width direction and a medicine introduced between its two-folded halves. The sheet can be thermal-bonded along an entire width ahead of and behind the medicine and along an entire length of open edge portions of the two-folded halves, thus forming the medicine packaging bag. A number of fine tearing cuts can be formed in a portion beginning at a distance (t) from an end edge of the open edge portions in a longitudinal direction of the sheet. A tearing cut-less portion can be formed between the cut portion and the end edge of the open edge portions. The tearing cut-less portion inhibits tears caused by tension through the cut when the sheet is drawn out. The bag can be easily torn by hand due to the cut portion.

12 Claims, 12 Drawing Sheets

(51) Int. Cl.

| | |
|---|---|
| ***B65B 9/073*** | (2012.01) |
| ***B65B 51/28*** | (2006.01) |
| ***B65B 61/02*** | (2006.01) |
| ***B65D 75/58*** | (2006.01) |
| *B65D 75/20* | (2006.01) |
| *B65D 75/42* | (2006.01) |
| *B65D 75/52* | (2006.01) |

(56) References Cited

U.S. PATENT DOCUMENTS

| | | | | |
|---|---|---|---|---|
| 5,038,547 | A * | 8/1991 | Kai et al. | 383/200 |
| 5,141,795 | A * | 8/1992 | Kai et al. | 428/138 |
| 5,511,665 | A * | 4/1996 | Dressel et al. | 206/532 |
| 5,826,985 | A * | 10/1998 | Goodman et al. | 383/200 |
| 5,908,113 | A * | 6/1999 | Takemasa et al. | 206/530 |
| 6,679,629 | B1 * | 1/2004 | Benito-Navazo | 383/200 |
| 7,493,744 | B2 * | 2/2009 | Nishimura et al. | 206/530 |
| 7,866,474 | B2 * | 1/2011 | Geser et al. | 206/532 |
| 2010/0107555 | A1 | 5/2010 | Yuyama et al. | |

FOREIGN PATENT DOCUMENTS

| | | | |
|---|---|---|---|
| JP | 61-142159 | | 6/1986 |
| JP | S6382965 | | 4/1988 |
| JP | 2000-318703 | A | 11/2000 |
| JP | 2004155501 | | 6/2004 |
| JP | 2006006377 | | 1/2006 |
| JP | 2006-182364 | A | 7/2006 |
| JP | 2006176207 | | 7/2006 |
| JP | 2006-306419 | A | 11/2006 |
| JP | 2007-290771 | A | 8/2007 |
| JP | 4220568 | | 11/2008 |

OTHER PUBLICATIONS

Chinese Patent Office, Official Action for Chinese Patent Application No. 201080042459.8, dated Apr. 24, 2013 (8 pages).

* cited by examiner

MEDICINE PACKAGING BAG AND SHEET FOR THE SAME

CROSS-REFERENCE TO RELATED APPLICATIONS

This application is a 35 U.S.C §371 national stage filling of International Application No. PCT/JP2010/065511, filed Sep. 9, 2010, the entire contents of which are incorporated by reference herein, which claims priority to Japanese Patent Application No. 2009-218889, filed Sep. 24, 2009, the entire contents of which are incorporated by reference herein.

TECHNICAL FIELD

The present invention relates to a bag for package of a medicine such as powdered medicines or tablets. Further, the present invention relates to a sheet for such a medicine packaging bag.

Currently, not only every medicine but also a medicine to be taken in the morning, at noon, in the evening, etc. is packaged in one bag for each of the morning, noon and evening, and the bag is then handed to a patient.

SUMMARY

As to the package for those medicines, referring to FIGS. 1 and 2 showing one embodiment of the invention according to this application, an elongated sheet 10 is folded centrally in a width direction thereof and a medicine a is introduced between two-folded halves 11, 11 of the sheet. Further, the elongated sheet 10 is thermal-bonded along an entire width ahead of and behind the medicine (a) in the folded elongated sheet 10 (the folded halves 11, 11) and along an entire length of open edge portions of the two-folded halves 11, 11 (front and rear entire width-bonded portions 12, an opening-bonded portion 13), thus forming the medicine packaging bag A. Each medicine packaging bag A is joined to another via a perforation 14.

Typically, in packaging medicines, the elongated sheet 10 folded in two halves is rolled into a roll shape and the medicine a is introduced into the sheet 10. The sheet is thermal-bonded along the entire width ahead of and behind the medicine a in the two-folded halves 11, 11 and along the entire length of the open edge portions of the two-folded halves 11, 11. In a position of packaging medicines, a heater roller is provided in a width direction of the sheet 10 and another heater roller is provided in the longitudinal direction of the sheet. The sheet 10 is intermittently sent from its roll by means of a feed roller and the two-folded halves 11, 11 of the sheet 10 are opened and the medicine a is then introduced. Further, at the same time, both of the heater rollers thermal-bond the sheet 10 along the entire width in the width direction of the sheet 10 as well as along the entire length of the open edge portions (in the longitudinal direction of the sheet 10) (see Paragraph [0060], FIG. 12 and FIG. 15 in Patent Document 1). By way of another example of means for thermal-bonding the sheet 10 in the width direction as well as in the longitudinal direction, an L-shaped (three-pronged shaped) heat pack may be used instead of the heater roller (see reference numeral 13 in FIG. 12 in Patent Document 2).

As for the medicine packaging bag A, one bag A corresponding to one dose is taken off from a group of consecutive bags shown in FIG. 1 through the perforation 14. Then, a notch is cut in one of the four side edges of such a bag by means of hands or scissors and the bag A is ripped open from the notch. The medicine is removed through such an opening and is then taken. When the side edge is ripped, it is not easy to cut the notch by means of hands. This is because the bag A (the sheet 10) is made from a plastic film. Particularly, it is not easy for the aged, children, hand-handicapped persons, etc. to do that.

Thus, as one example of a packaging bag made from a plastic film, as shown in FIG. 6 and FIG. 7A, there is a bag formed with a large number of cuts b in the ripping side edge (see claims, FIG. 1 and FIG. 4 in Patent Document 1). In the figure, reference numeral c denotes a thermal-bonding seal portion. As to the side edge with such cuts b formed therein, as shown in FIG. 7B, if one side and the opposite side on the boundary of the cut b are pulled off and then torn off in opposite directions to separate apart as shown by the arrows, then a notch is made to reach the cut b as shown by the dashed lines and the bag can be cut open (unsealed) from the notch line and the cut b. The medicine packaging bag A may also employ the configuration of the cut b.

Patent Document 1: Japanese Patent No. 4220568

Patent Document 2: Japanese Laid-Open Patent Application No. 2006-306419

Patent Document 3: Japanese Laid-Open Patent Application No. (Sho)61-142159

Patent Document 4: Japanese Laid-Open Patent Application No. 2000-318703

The medicine packaging bag A with the above-described cuts b formed therein is effective in terms of tearability. As to the elongated sheet 10, however, there is a problem when introducing and packaging the medicine a. That is, when packaging medicines, a tension acts on the elongated sheet 10 in the longitudinal direction of the sheet as well as in the width direction thereof when drawing out the sheet from its roll, when pressing the sheet through thermal-bonding by the heater roller, and when drawing out (sending) the sheet after the thermal-bonding. Thus, there is a problem since the sheet is torn from the cut b due to such a tension. As such, the sheet cannot be smoothly drawn out or sent (traveled).

It is an object of the present invention to prevent tear of the cut b caused by the tension when drawing out the sheet.

To achieve the above object, as can be understood from FIG. 7A, the following is found from the prior art: the cut b is open at an end edge of the side edge; and the cut b tears large through such an opening due to the presence of the opening when a tension is applied to the sheet 10, thus rendering the sheet 10 not to be drawn out smoothly. To avoid tear through the opening, according to the present invention, a portion with cuts is formed at a predetermined distance inwardly from an end edge of the side edge, at which such cuts are to be located. Further, a tearing cut-less portion is formed between the tearing cut portion and the end edge along an entire length in a longitudinal direction of the sheet.

By forming the portions as such, due to the presence of the tearing cut-less portion, the tear caused by the tension through the opening does not occur and the sheet can be smoothly drawn out. As to the width t (see FIG. 2) of the tearing cut-less portion, a distance (width), through which the tension in a longitudinal direction during sending the sheet is difficult to tear the open edge portion, and through which a force of a human such as the aged is easy to tear the open edge portion, is suitably determined through tests. For example, if the sheet is a 20~30μ, thick composite film wherein a polyethylene film is bonded to a cellophane film, and the width of the tearing cut portion is 4 mm, then the width t is determined to be 1±0.5 mm.

The present invention provides a medicine packaging bag, wherein an elongated sheet is folded centrally in a width direction thereof and a medicine is introduced between two-folded halves of the sheet, and wherein the elongated sheet is thermal-bonded along an entire width ahead of and behind the medicine and along an entire length of open edge portions of the two-folded halves. A thermal-bonded portion in the entire length of the open edge portions of the two-folded halves is formed inwardly from an end edge of the open edge portions at a predetermined distance. A large number of fine tearing cuts are formed between the thermal-bonded portion and the end edge of the open edge portions along an entire length in a longitudinal direction of the elongated sheet. The tearing cuts are formed inwardly from the end edge of the open edge portions at a distance, through which a tension in a longitudinal direction during sending the sheet is difficult to tear the sheet, and through which a human force is easy to tear the sheet. A tearing cut-less portion is formed between the tearing cut portion and the end edge of the open edge portions along the entire length in the longitudinal direction.

In the above-described configuration, as to the features wherein the thermal-bonded portions are along the entire width of the elongated sheet ahead of and behind the medicine and along the entire length of the open edge portions in the two halves, and wherein the tearing cuts are along the entire length of the open edge portions, the thermal-bonded portions or the tearing cuts are not needed to continue (exist) along the entire length or the entire width. It is a matter of course that they may be intermittent as long as this does not cause any obstruction.

Similar to a prior art, the above-configured medicine packaging bag may be manufactured by drawing out the elongated sheet from its roll. The tearing cut portion may be formed on the elongated sheet in advance or may be formed at the same time as forming the bonded portions (when packaging the medicine). In case of the former, i.e., forming the tearing cut portion in advance, for example, a large number of fine tearing cuts may be formed at both lateral edges of the elongated sheet along an entire length in a longitudinal direction thereof. Further, a large number of fine tearing cuts may be formed in the open edge portions of the two-folded halves of the sheet folded centrally in its width direction along the entire length in its longitudinal direction. In case of forming the tearing cuts in advance, the tearing cuts are formed inwardly from the end edge of the open edge portion at a distance, through which the tension in the longitudinal direction during sending the sheet is difficult to tear the sheet, and through which a human force is easy to tear the sheet. Further, the tearing cut-less portion is formed along the entire length in the longitudinal direction.

According to the present invention, as described above, the portion with cuts is formed at a predetermined distance inwardly from the end edge at which the cuts are to be located. Further, the tearing cut-less portion is formed between the tearing cut portion and the end edge along the entire length in the longitudinal direction of the sheet. Accordingly, the tear through the cut, which is caused by the tension during drawing out the elongated sheet for medicine packaging bags, can be prevented and the medicine packaging bag can be opened due to easy tear.

DETAILED DESCRIPTION

Figure 1:
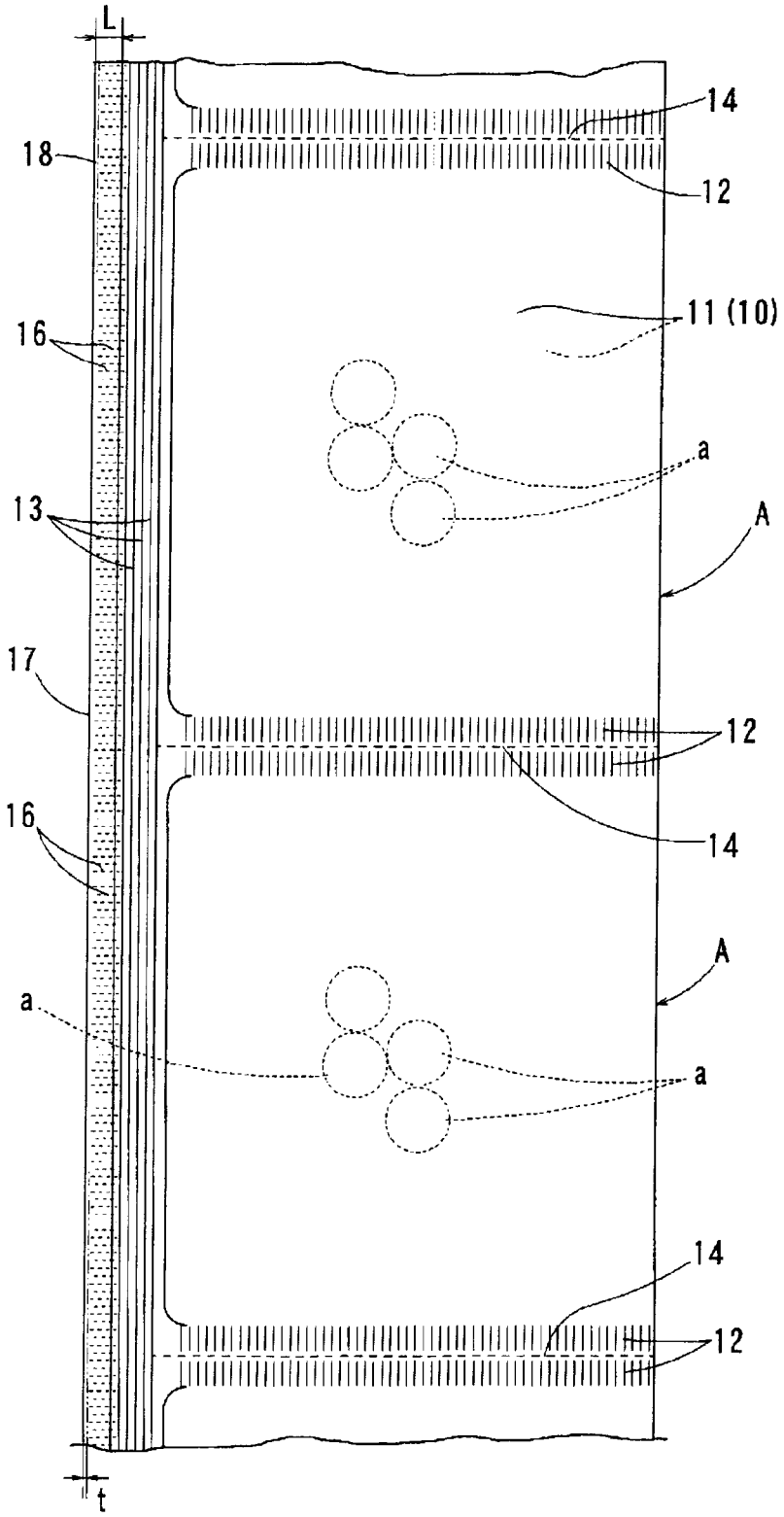
FIG. 1 is a front view showing one embodiment of a medicine packaging bag in accordance with the present invention.
Figure 2A:
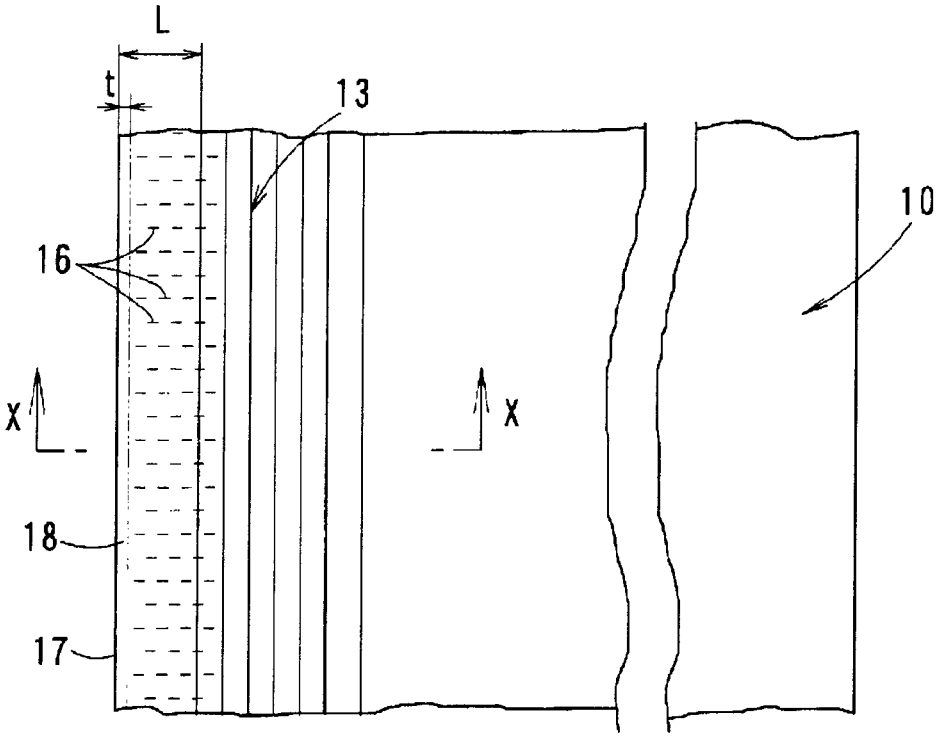
FIG. 2 is an enlarged view showing a main part of FIG. 1.
Figure 2B:
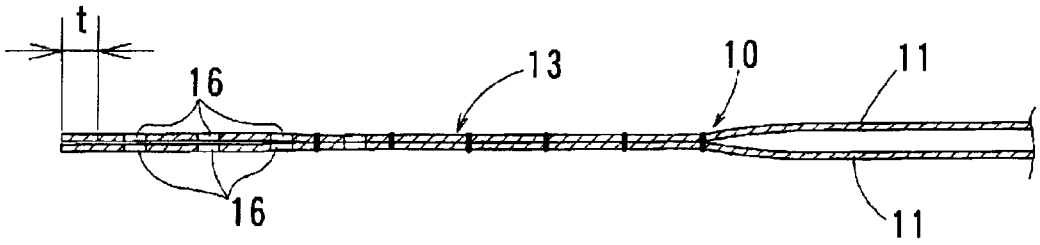

One embodiment of a medicine packaging bag A according to the present invention is shown in FIG. 1 and FIG. 2. In the medicine packaging bag, similar to the prior art, an elongated sheet 10 is folded centrally in its width direction and a medicine a is introduced into between its two-folded halves 11, 11. Further, the elongated sheet 10 is thermal-bonded along an entire width ahead of and behind the medicine a as well as an entire length of open edge portions of the two-folded halves (front and rear entire width-bonded portions 12, an opening-bonded portion 13). Each medicine packaging bag A is joined to another medicine packaging bag via a perforation 14. The opening-bonded portion 13 is formed inwardly from an end edge 17 of the open edge portion by, for example, L=4 mm.

The sheet 10 is a composite film of 20μ, in thickness, wherein a thermal-bondable polypropylene film is superposed on a cellophane film of a substrate layer such that the thermal-bondable polypropylene film is interior. In this connection, the sheet 10 may be formed in such a manner that an anchor coat agent (a bonding agent) is applied on the cellophane film and both polyethylene to be a bonding agent and polyethylene to be a seal layer are coated on the film through extrusion from a T die with the former as an anchor coat agent.

In the medicine packing bag A, similar to the prior art, the elongated sheet 10 is drawn out from its roll to a medicine packaging position and then processes of introducing medicines and producing packaging bags (packaging medicines) are performed. The elongated sheet 10 according to this embodiment is rolled as folded centrally in its width direction. The elongated sheet is formed with a large number of fine tearing cuts 16 in the open edge portions of its two-folded halves 11, 11 by means of a cut ring 20 shown in FIGS. 3 and 4.

Figure 3A:
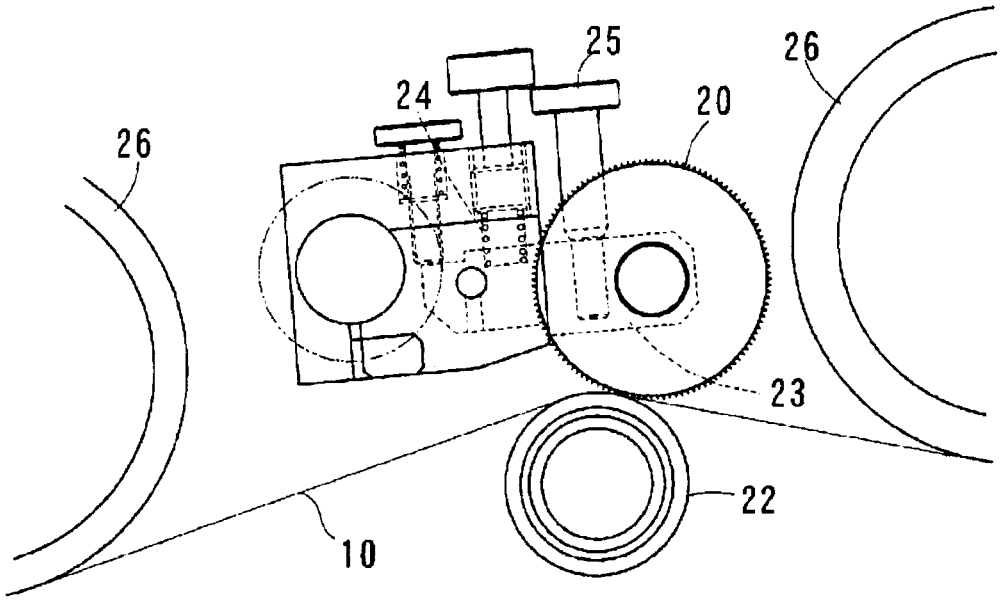
FIG. 3A is a schematic front view showing the formation of a tearing cut portion in the embodiment.
Figure 3B:
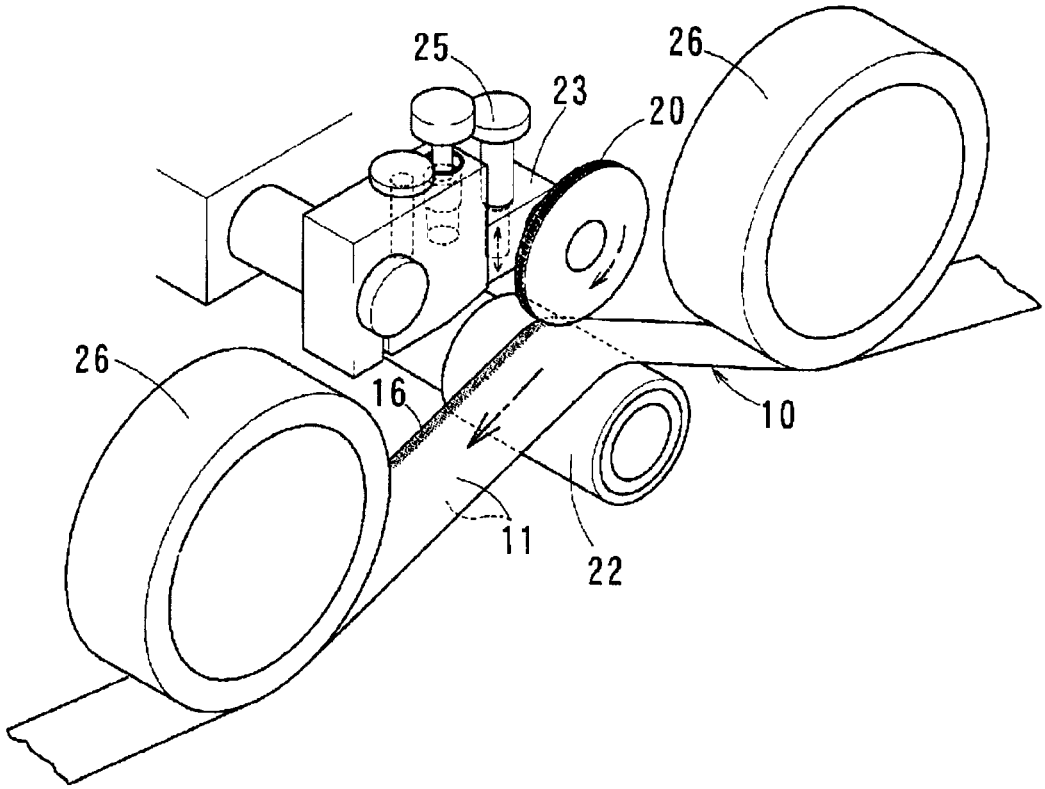
FIG. 3B is a perspective view showing the formation of a tearing cut portion in the embodiment.
Figure 4A:
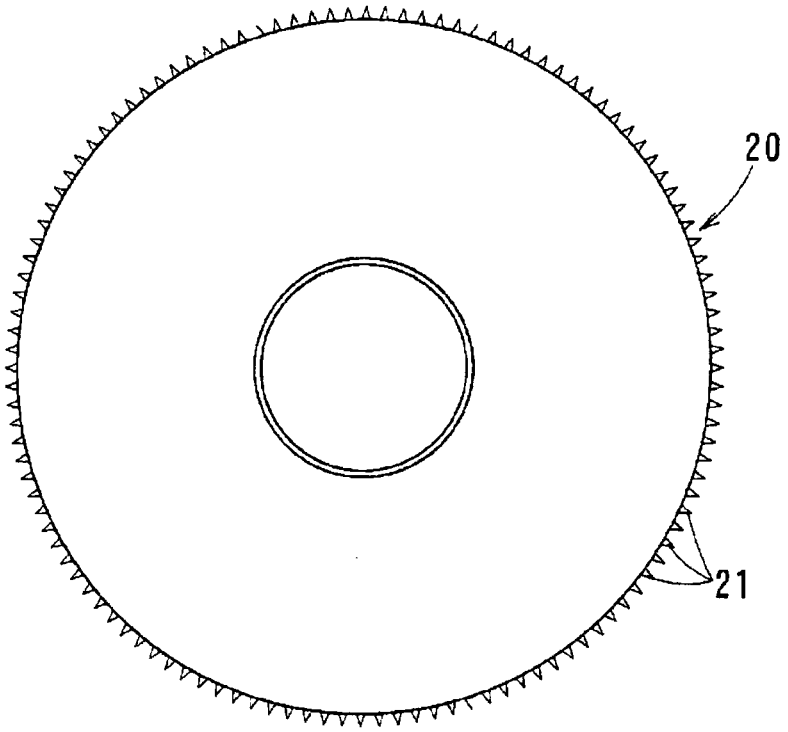
FIG. 4A is a front view showing a ring for forming the tearing cut portion.
Figure 4B:
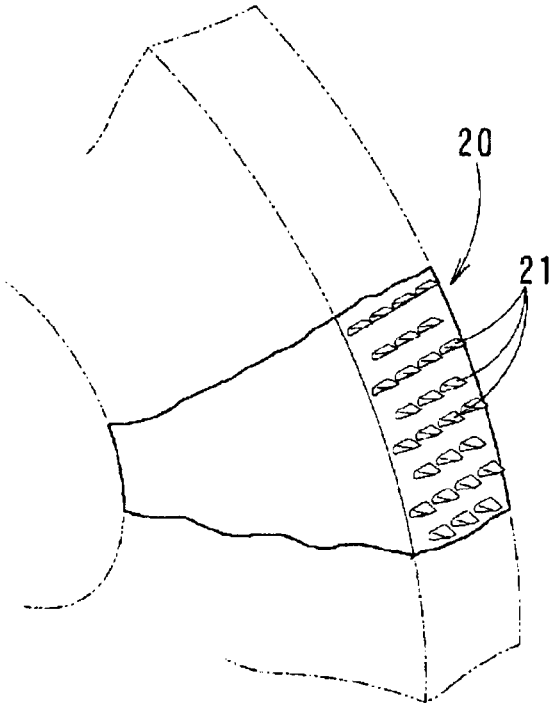
FIG. 4B is a perspective view showing a main part of the ring.
Figure 4C:
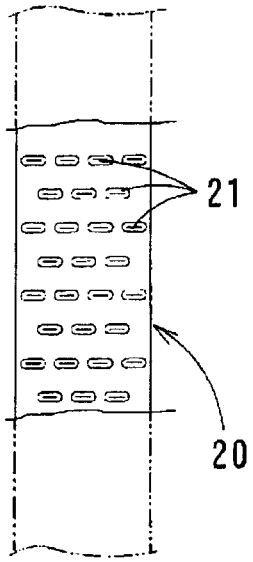
FIG. 4C is a right side view showing the main part of the ring.

As shown in FIGS. 4A to 4C, elliptical cone-shaped protrusions 21 are provided at equal spacing along an entire periphery of the cut ring 20. As shown in FIG. 3, the sheet (film) 10 sent (drawn out) from the roll is sent between the cut ring 20 and a resinous anvil roller 22. The cut ring 20 is rotatably provided in a rocking piece 23. The rocking piece 23 is biased downwardly by a spring 24, while being vertically movable by a handle 25. Thus, the cut ring 20 presses the sheet 10 against the anvil roller 22 with a suitable force with the sheet therebetween. Such press allows each protrusion 21 of the cut ring 20 to pierce both two-folded halves 11, 11 to come to the anvil roller 22. In this regard, the anvil roller 22 has softness enough that the protrusion 21 can be inserted to the anvil roller.

Guide or drive rollers 26, 26 (see FIG. 3) are provided before and behind in a sheet travel direction at the cut ring 20. A downstream drive roller 26 (the left one in the figures) has a width narrower than an upstream guide roller 26. The sheet 10 is traveled by the downstream roller 26. As the sheet 10 travels, the cut ring 20 pressed to the anvil roller 22 via the sheet 10 rotates.

If the cut ring 20 is rotated, then the protrusions 21 pierce the sheet to thus form the cuts 16, which are through holes made by such piercing, in the open edge portions of the two-folded halves 11, 11. Further, as the sheet 10 travels, a large number of the cuts 16 are formed along an entire area of the entire length in the longitudinal direction of the sheet (see FIG. 2B). For example, the tearing cuts 16 are formed along the entire area of the entire length in the longitudinal direction of the sheet 10, while being inwardly from the end edge of the open edge portion by t=1 mm and in the range of 4 mm in width. A motor may rotate the cut ring 20 and such rotation may travel the sheet 10. In this case, the anvil roller 22 may also be rotated at the same peripheral speed as the cut ring 20 in synchronism therewith.

When forming the cuts b, the area, at which the cuts b are made by the protrusions 21 of the cut ring 20, is positioned inwardly in the width direction from the end edge 17 of the open edge portions of the two-folded halves 11, 11 to have a width of a distance t (see FIG. 2). Thus, a tearing cut-less portion 18 without the tearing cuts is formed between the tearing cut portion 16 and the end edge 17 of the open edge portion along the entire length in the longitudinal direction of the sheet 10. Accordingly, due to the tearing cut-less portion 18, it is difficult that a tension in the longitudinal direction during the travel tears the sheet 10 formed with the tearing cut portion 16 (the sheet 10 located behind the cut ring 20 in FIG. 3B). Thus, the sheet can perform the smooth travel. The cut portion 16 and the thermal-bonded portion 13 may be overlapped in part as shown in FIG. 2, or otherwise, may not be overlapped.

The elongated sheet 10 with the cuts 16 is rolled into a roll shape and such a roll is led to the medicine packaging position by setting the same in a medicine packaging device. When the medicine packaging device is driven from such a state, similar to the prior art, the sheet 10 is intermittently sent from its roll by means of a feed roller. When the sheet 10 is stopped, the open edge portions of the two-folded halves 11, 11 are opened and the medicines are introduced thereto. Further, at the same time, both heater rollers thermal-bond the sheet 10 along the entire width in the width direction and the entire length of the open edge portion (in the longitudinal direction of the sheet 10) (the front and rear entire width-bonded portions 12, the opening-bonded portion 13), thereby producing the medicine packaging bag A and further producing the medicine packaging bags A joined to one another via the perforation 14 (see FIG. 1).

When packaging the medicine, a tension acts on the elongated sheet 10 in the longitudinal direction thereof as well as in the width direction thereof when drawing out the sheet from the roll, when pressing the sheet through thermal-bonding by the heater roller, and when drawing out (sending) the sheet after the thermal-bonding. However, due to the presence of the tearing cut-less portion 18 without the tearing cut portion 16, which extends along the entire length in the longitudinal direction of the sheet, it is difficult that tear of the sheet caused by such a tension occurs. Further, the sheet is smoothly traveled (smoothly sent). Thus, it does not occur that the process of packaging medicines stops or a packaging mechanism has trouble.

As for the medicine packaging bag A, similar to the prior art, one bag A corresponding to one dose is taken off from a group of consecutive bags shown in FIG. 1 through the perforation 14. Then, a notch is cut in one of the four side edges of such a bag by means of hands or scissors and the bag A is ripped open from the notch. The medicine a is removed through such an opening and is then taken. When the bag A is ripped open by means of hands, the cuts b ensure the tearability of the sheet. Thus, the aged, children, hand-handicapped persons, etc. can easily open such an opening.

Figure 5:
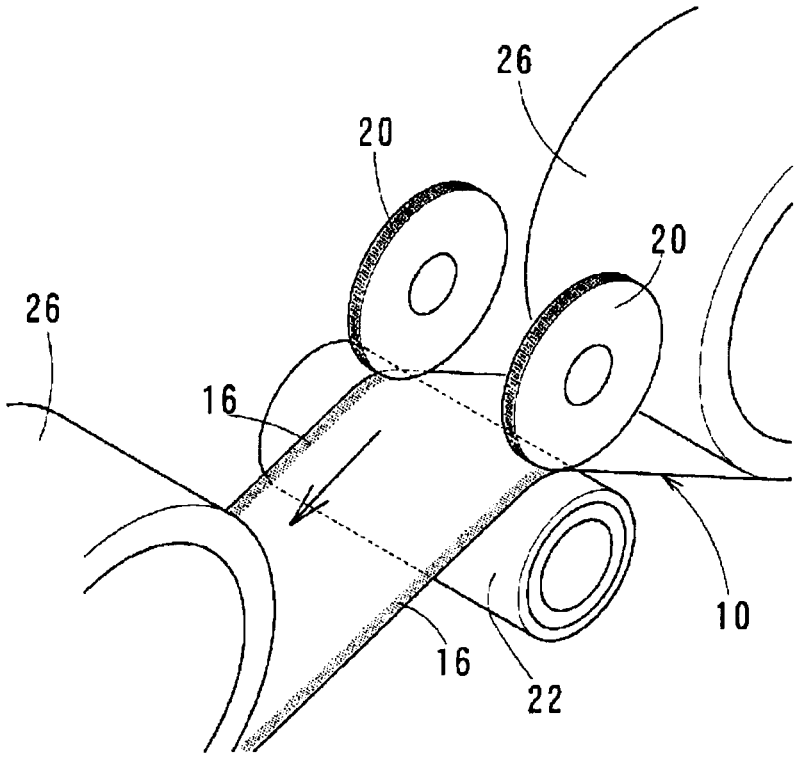
FIG. 5 illustrates formation of a tearing cut portion in accordance with another embodiment.
Figure 6:
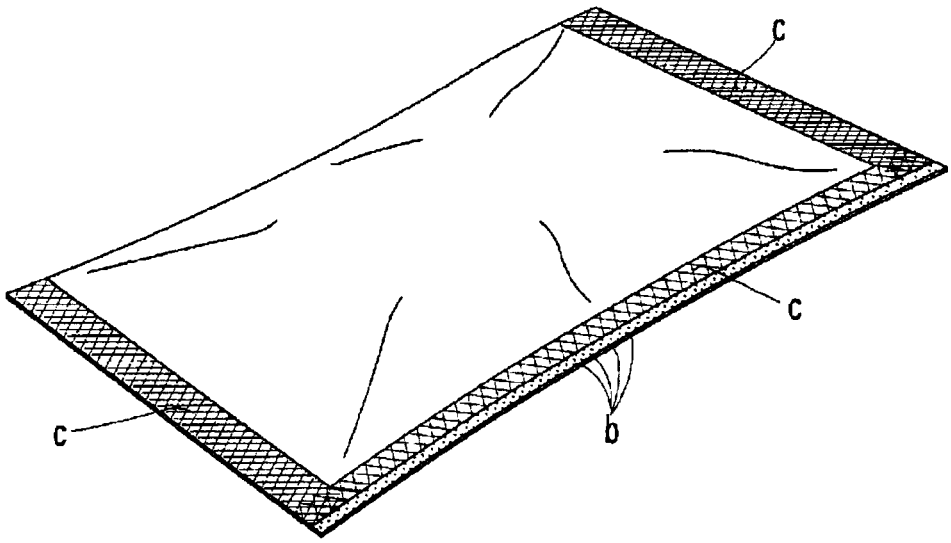
FIG. 6 is a perspective view showing a prior art packaging bag with a tearing cut portion.
Figure 7A:
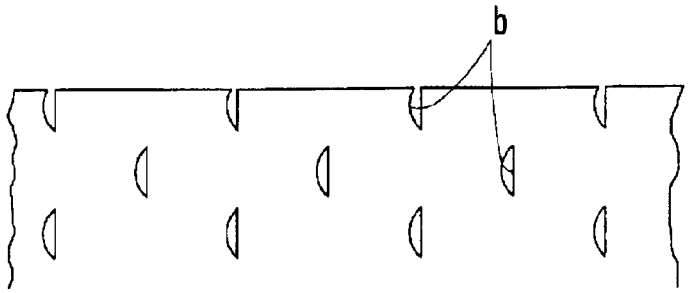
FIG. 7A is an enlarged view of the tearing cut portion shown in FIG. 6.
Figure 7B:
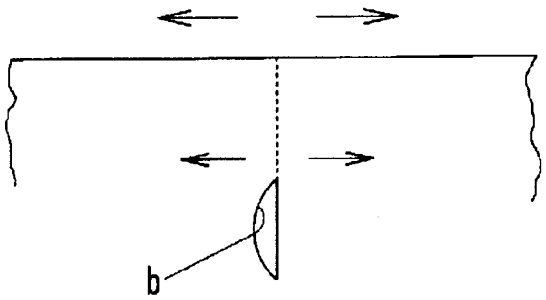
FIG. 7B shows the function of the tearing cut portion.

In this embodiment, the tearing cut portions 16 are simultaneously formed in the two-folded halves 11, 11 of the sheet 10. However, instead of folding the sheet, a large number of fine tearing cuts 16 may be formed in both lateral edge portions of one sheet 10 along the entire length in the longitudinal direction thereof, as shown in FIG. 5. In this case, the cut ring 20 and the anvil roller 22 are provided at the both lateral edge portions respectively. In the sheet 10 with the tearing cuts 16 formed in its both lateral edge portions, a former comprised of a triangular plate, which folds the sheet 10 in half at a midpoint in a width direction thereof (see Numeral 20 in FIG. 6 in Patent Document 4), folds the sheet in half before introducing the medicine a.

The above-described sheet 10 is not limited to the thermal-bonding of the heat roller. It is a matter of course that the sheet may be employed to a medicine packaging device utilizing thermal-bonding of the above-described L-shaped heat pack. This also can provide the functional effects of the present invention. Further, the thickness of the sheet 10 is not limited to 20μ. A sheet having a thickness of currently-used 30μ, etc. as well as a sheet having a different thickness may be employed. Further, the material of the sheet is not limited to the above-described composite film consisting of cellophane and polyethylene and may include a material referred to as glassine. It is understood that transparent glassine or vapor-deposited glassine may be used.

Further, the cut ring 20 may be provided in the front or rear of the heater roller (heat pack) in the sheet travel direction and the tearing cut portion 16 may be formed by the rotation of the cut ring 20 prior or subsequent to the thermal-bonding. In this case, it does not occur that the sheet 10 is torn due to the cuts 16 before a medicine packaging part and the travel of the sheet is obstructed thereby. In particular, the formation of the cuts subsequent to the thermal-bonding is more effective since the thermal-bonding is already performed and thus tear resistance of the sheet 10 improves due to such thermal-bonding.

Description of Reference Numerals

10 . . . Sheet (film) for medicine packaging bag, 11 . . . Folded halves of sheet, 12, 13 . . . Thermal-bonded portion, 14 . . . Perforation, 16 . . . Tearing cut (Tearing cut portion), 17 . . . End edge of open edge portion, 18 . . . Tearing cut-less portion, 20 . . . Cut ring, 21 . . . Cut forming protrusion, A . . . Medicine packaging bag

What is claimed is:

1. A plurality of medicine packaging bags, comprising:

an elongated sheet folded centrally in a width direction thereof so as to define two-folded halves of the sheet and including relatively fine tearing cuts and perforations being defined therein, the sheet being configured to be drawn into a medicine packaging device, wherein:

a medicine is introduced between the two-folded halves of the sheet having the relatively fine tearing cuts therein, the two-folded halves of the sheet are thermal-bonded to one another in a first region along an entire width of the folded sheet ahead of and behind the medicine and in a second region along an entire length of open edge portions of the two-folded halves in a longitudinal direction of the sheet, said relatively fine tearing cuts are defined in a tearing cut portion of the second region beginning only at a spaced distance (t) from an end edge of the open edge portion of each half along the entire length of the open edge portion of that half in the longitudinal direction of the sheet such that each bag of the plurality of medicine packaging bags is laterally tearable by a human hand force, the perforations are formed in a width direction of the sheet and the tearing cuts are spaced apart from the perforations in the width direction of the sheet, and a tearing cut-less portion of the second region being defined in a portion of the second region between the end edge of the open edge portion and the distance (t) along the entire length of the open edge portion in the longitudinal direction of the sheet so as to inhibit tearing of the sheet by a tension applied to the sheet in the longitudinal direction when the sheet is drawn into the medicine packaging device.

2. An elongated sheet for a medicine packaging bag, the sheet being folded centrally in a width direction so as to define two-folded halves of the sheet and including relatively fine tearing cuts and perforations defined therein, the sheet being configured to be drawn into a medicine packaging device, wherein the tearing cuts are defined in a respective tearing cut portion of each of the two-folded halves beginning only at a spaced distance (t) from an end edge of an open edge portion of that folded half along the entire length of that open edge portion in a longitudinal direction of the sheet such that the sheet is laterally tearable by a human hand force, wherein the perforations are formed in a width direction of the sheet and the tearing cuts are spaced apart from the perforations in the width direction of the sheet, and wherein a tearing cut-less portion is defined in each of the two-folded halves between the end edge of the open edge portion of that half and the distance (t) along the entire length of that open edge portion in the longitudinal direction of the sheet so as to inhibit tearing of the sheet by a tension applied to the sheet in the longitudinal direction when the sheet is drawn into the medicine packaging device.

3. An elongated sheet for a medicine packaging bag including relatively fine tearing cuts and perforations defined therein, the sheet being configured to be drawn into a medicine packaging device, wherein the tearing cuts are defined in a respective tearing cut portion of each open edge portion of the sheet beginning only at a spaced distance (t) from an end edge of that open edge portion along the entire length of that open edge portion in a longitudinal direction of the sheet such that the sheet is laterally tearable by a human hand force, wherein the perforations are formed in a width direction of the sheet and the tearing cuts are spaced apart from the perforations in the width direction of the sheet, and wherein a tearing cut-less portion is defined in each of the open edge portions between the end edge of that open edge portion and the distance (t) along the entire length of that open edge portion in the longitudinal direction of the sheet so as to inhibit tearing of the sheet by a tension applied to the sheet in the longitudinal direction when the sheet is drawn into the medicine packaging device.

4. The medicine packaging bag of claim 1, wherein each of he end edges is straight.

5. The elongated sheet of claim 2, wherein each of the end edges is straight.

6. The elongated sheet of claim 3, wherein each of the end edges is straight.

7. The medicine packaging bag of claim 1, wherein the perforations are formed while the sheet is drawn into the medicine packaging device.

8. The elongated sheet of claim 2, wherein the perforations are formed while the sheet is drawn into the medicine packaging device.

9. The elongated sheet of claim 3, wherein the perforations are formed while the sheet is drawn into the medicine packaging device.

10. The medicine packaging bag of claim 1, wherein the medicine packaging bags of the plurality are joined to one another via the perforations.

11. The elongated sheet of claim 2, wherein the elongated sheet is for a plurality of medicine packaging bags, and wherein the medicine packaging bags of the plurality are joined to one another via the perforations.

12. The elongated sheet of claim 3, wherein the elongated sheet is for a plurality of medicine packaging bags, and wherein the medicine packaging bags of the plurality are joined to one another via the perforations.

* * * * *